US012342854B1

(12) United States Patent
Yi et al.

(10) Patent No.: US 12,342,854 B1
(45) Date of Patent: Jul. 1, 2025

(54) UNIVERSAL WATER PIPE ADAPTER

(71) Applicants: John Yi, Bethpage, NY (US); Jon Suh, Ambler, PA (US); Sean Suh, Milltown, NJ (US)

(72) Inventors: John Yi, Bethpage, NY (US); Jon Suh, Ambler, PA (US); Sean Suh, Milltown, NJ (US)

( * ) Notice: Subject to any disclaimer, the term of this patent is extended or adjusted under 35 U.S.C. 154(b) by 0 days.

(21) Appl. No.: 18/741,414

(22) Filed: Jun. 12, 2024

(51) Int. Cl.
*A24F 1/30* (2006.01)
*A24F 7/02* (2006.01)

(52) U.S. Cl.
CPC . *A24F 1/30* (2013.01); *A24F 7/02* (2013.01)

(58) Field of Classification Search
CPC ..... A24F 1/30
See application file for complete search history.

(56) References Cited

U.S. PATENT DOCUMENTS 2,996,067 A * 8/1961 Heine ..... A24F 7/04 131/331
12,043,469 B1 * 7/2024 Graybill ..... A45F 3/18
2009/0235939 A1 * 9/2009 Gonsalves ..... A24F 1/28 131/191
2013/0047997 A1 * 2/2013 Lennon ..... A24F 1/30 131/173
2013/0146070 A1 * 6/2013 Ross ..... A24F 1/30 131/225
2018/0020718 A1 * 1/2018 Thoede, Jr. ..... A24F 1/02 131/328
2018/0035710 A1 * 2/2018 Robles ..... F16K 27/06
2018/0049468 A1 * 2/2018 Nagel ..... A24F 1/02
2020/0405980 A1 * 12/2020 Griscik ..... A24F 40/42
2022/0361563 A1 * 11/2022 Mete ..... A24F 1/30
2023/0033764 A1 * 2/2023 Lee ..... A24F 7/00
2023/0148659 A1 * 5/2023 Capiti ..... A24F 13/12 131/330
2024/0049796 A1 * 2/2024 Moloney ..... A24D 1/20

* cited by examiner

*Primary Examiner* — Eric Yaary
(74) *Attorney, Agent, or Firm* — Kim IP Law Group LLC

(57) ABSTRACT

A universal water pipe adapter for use with a disposable container is provided. The universal water pipe adapter includes a cap housing having a cap universal engagement gasket configured to removably engage a container mouth of the disposable container. A slide port is formed in a cap cover to connect the cap cover to a cap cavity. A slide assembly having a slide bowl and a slide tube is passed through the slide port. An inhale channel is positioned on the cap cover and connects an inhale port to the cap cavity.

10 Claims, 11 Drawing Sheets

UNIVERSAL WATER PIPE ADAPTER

The exemplary embodiments of present invention relate generally to water pipes and, more specifically, to a device for converting disposable containers into water pipes.

BACKGROUND OF THE DISCLOSURE

Traditional direct smoking of substances raises health concerns arising from the natural presence of harmful chemicals that are inhaled during the burning process. One known approach to minimize the inhalation of excess chemicals has been through the use of water pipes. Water pipes pass the smoke generated from the combustion of plant materials through a water bath. This both cools the vapor and removes some of the impurities. Water pipes, however, often rely on specialized glass containers that are unwieldly, expensive, breakable, and messy. These glass containers are difficult to clean, may become stained, and often require the use of harsh cleaning chemicals. This can serve to further increase the chemicals inhaled by users. In addition, existing products often fail to adequately filter the vapor prior to inhalation. It would be beneficial to have a water pipe that reduced the user's exposure to carcinogens. In addition, it would be beneficial to have a water pipe design that utilizes disposable containers to provide a cost effective and sanitary device that eliminates the need for complex cleaning.

BRIEF SUMMARY OF THE DISCLOSURE

In accordance with an exemplary embodiment there is provided a universal water pipe adapter for use in combination with a container including disposable containers. The water pipe adapter includes a cap housing comprised of a cap cover, a cap cavity, and a cap engagement gasket. The cap engagement gasket is configured to removably engage a container mouth of the disposable container. A slide port may be formed in the cap cover to allow a slide assembly to be inserted therethrough. The slide assembly includes a slide bowl and a slide tube. An inhale channel is positioned on the cap cover and connects an inhale port to the cap cavity.

According to another aspect, the cap engagement gasket of the universal water pipe adapter includes a flange support and a plurality of semi-flexible flange discs tapered from a first engagement gasket end to a second engagement gasket end. According to another aspect, the universal water pipe adapter includes a removable mouthpiece having a breathing end and an attachment end. The attachment end is configured to removably engage the inhale port.

According to another aspect, semi-flexible discs extend from the flange support towards a cap centerline axis.

According to another aspect, semi-flexible discs extend from the flange support away from a cap centerline axis. According to another aspect, the cap housing may be made of a material having one of anti-bacterial properties, anti-bacterial additives, anti-bacterial films, and anti-bacterial coatings. According to another aspect, the slide assembly may be made of one of metal, plastic, silicon, rubber, and glass.

According to another aspect, the universal water pipe adapter may include a carb port positioned externally from the cap cavity and in communication with the cap cavity. According to another aspect, the universal water pipe adapter may include a carb tube surrounding the slide tube, the carb tube including a carb port positioned on the carb tube proximate the slide bowl.

In accordance with the exemplary embodiments there are provided universal water pipe adapters allowing conversion of a disposable container into a working water pipe with improved filtration. As a result, the container of the water pipe may be disposed of and replaced rather than requiring cleaning. In addition to the aforesaid universal water pipe adapter, the subject disclosure provides a method of integrating a filter system into the water pipe for further removal of chemicals or other adulterants.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
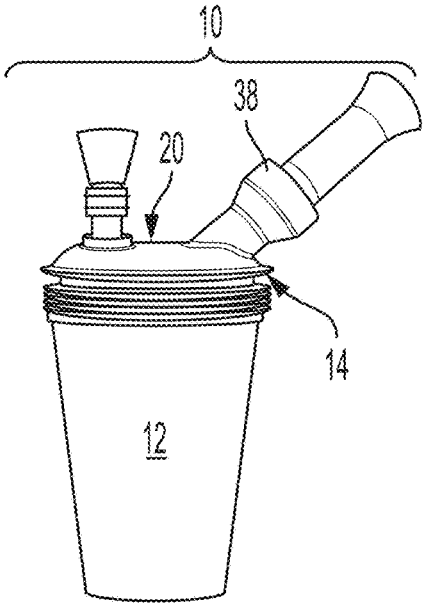
FIG. 1 is a side view of a universal water pipe adapter in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of +20%, +10%, +5%, +1%, or +0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 2:
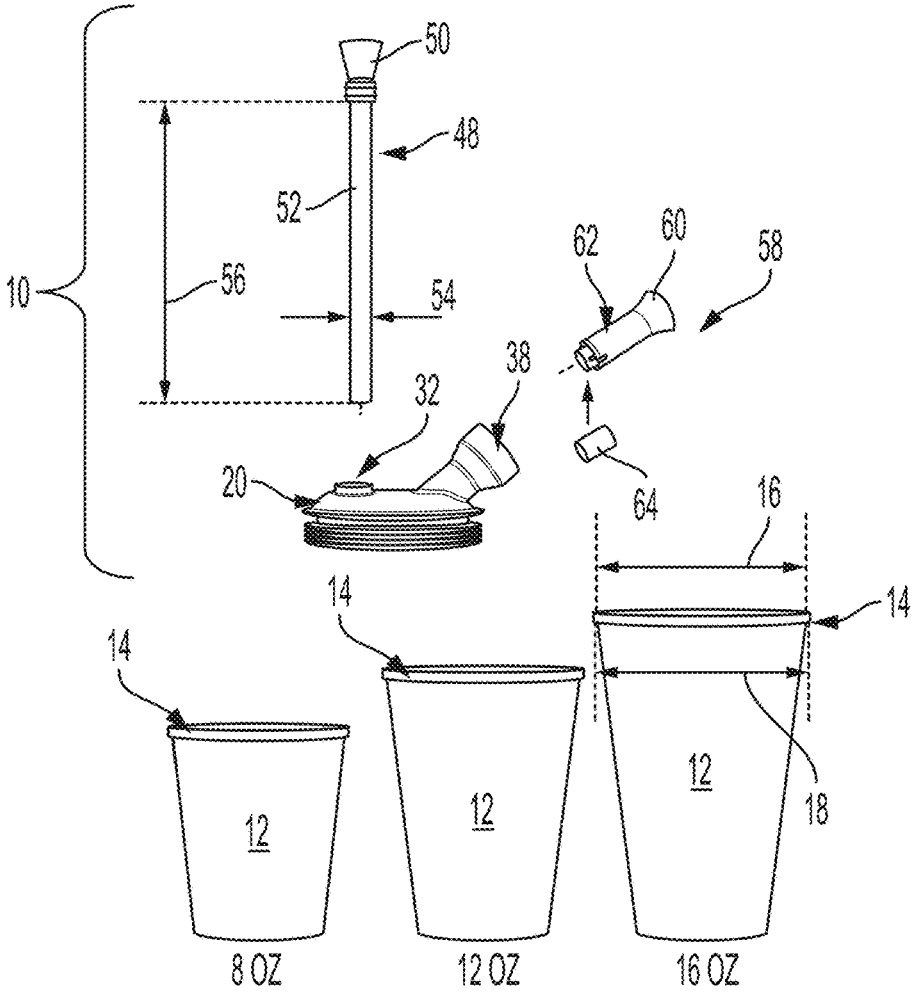
FIG. 2 is an exploded side view of the universal water pipe adapter of FIG. 1.

Referring now to the drawings, FIGS. 1 and 2 illustrate a universal water pipe adapter 10 constructed in accordance with an exemplary embodiment of the subject disclosure. The universal water pipe adapter 10 is adapted for use with a container, such as a disposable container 12. The disposable container 12 may be any kind of container such as a coffee cup, a drink cup, a bottle, a can or even a jar. The disposable container 12 includes a container mouth 14 having a mouth inner diameter 16 and a mouth outer diameter 18. The disposable container 12 may be of any material or size such as paper, glass, ceramic, metal, and/or plastic.

Figure 3:
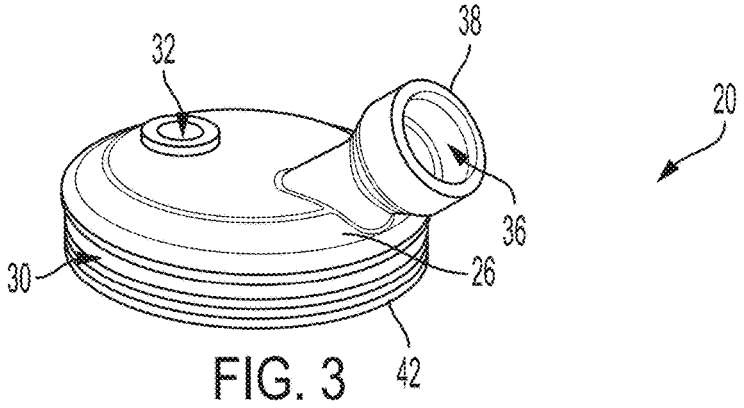
FIG. 3 is a perspective view of a cap housing for use with the universal water pipe adapter of FIG. 1.
Figure 4A:
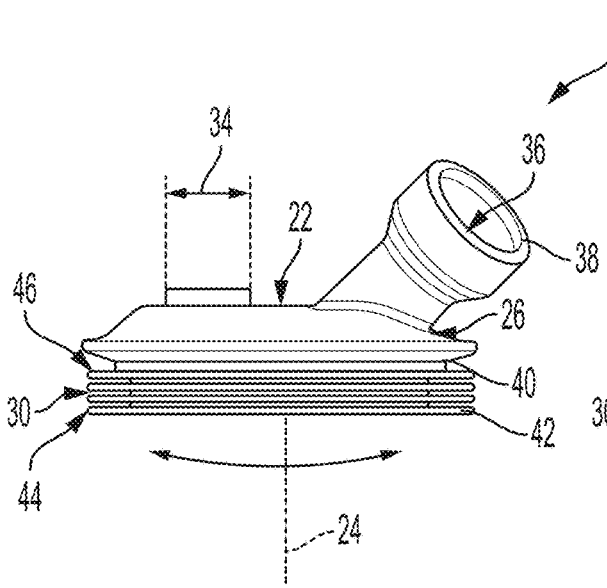
FIG. 4A is a side view of the cap housing of FIG. 3.
Figure 4B:
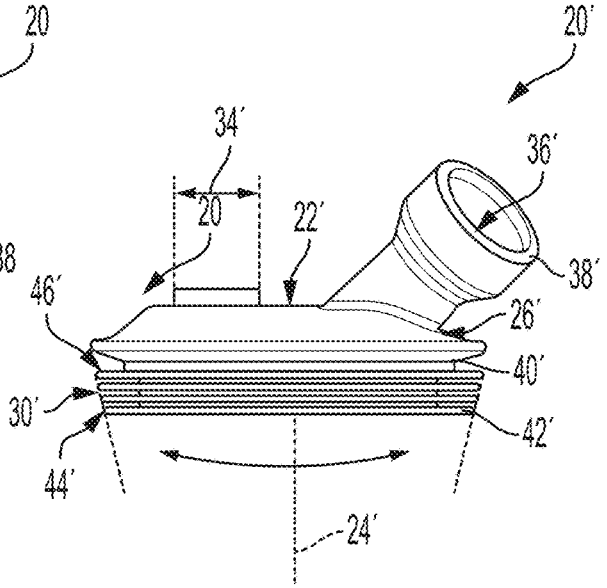
FIG. 4B is a side view of a cap housing in accordance with another exemplary embodiment of the subject disclosure.
Figure 5:
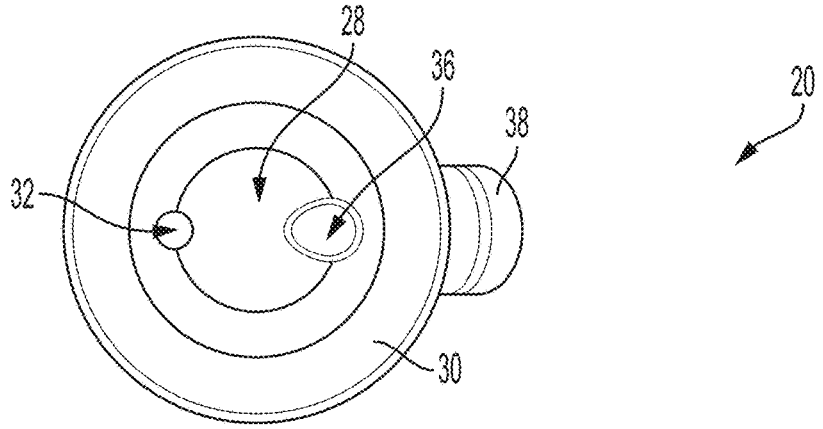
FIG. 5 is a bottom view of the cap housing of FIG. 3.

Referring now to FIGS. 3-5, the universal water pipe adapter 10 includes a cap housing 20 comprised of a cap cover 22, a cap centerline axis 24, a cap cavity 28 and a cap universal engagement gasket 30. The cap cover includes a sloped side panel 26.

The cap housing 20 may be made of any of a variety of materials including, but not limited to, metal, plastic, silicon, rubber, and/or ceramic. In one aspect, the cap housing 20 is made of or includes materials having anti-bacterial properties to prevent unwanted bacterial growth or contamination. These properties are useful as the universal water pipe adapter 10 is intended to come into contact with a user's mouth during operation. In another aspect, the cap housing 20 may include anti-bacterial additives, films or coatings to achieve similar benefits.

Figure 21:
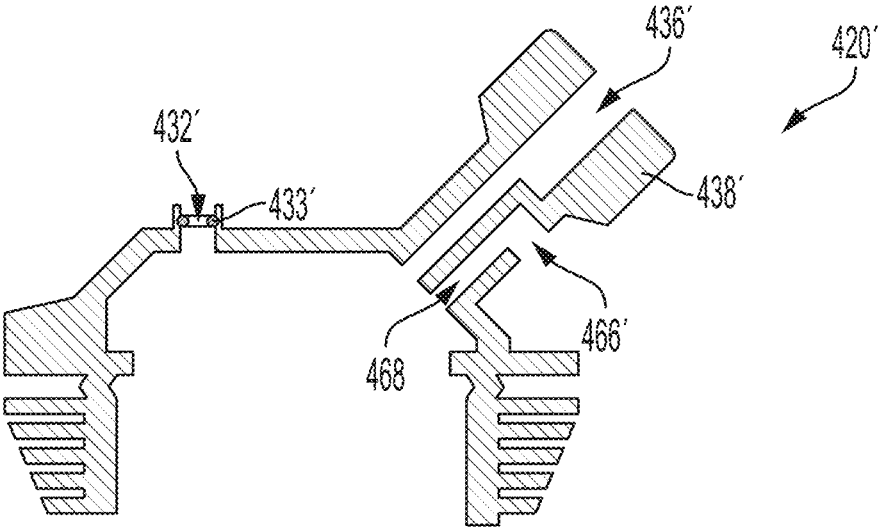
FIG. 21 is a cross-sectional view of the cap housing in accordance with another exemplary embodiment of the subject disclosure.

The cap housing 20 includes a slide port 32 formed in the cap cover 22. The slide port 32 defines a slide port diameter 34. The slide port 32 may include additional sealing features which would be evident in light of the present disclosure, such as a sealing gasket 433' (FIG. 21).

The cap housing 20 further includes an inhale port 38 in fluid communication with the cap cavity 28 and defining an inhale channel 36. The cap universal engagement gasket 30 is configured to removably engage and seal to the container mouth 14 such that the cap housing 20 may be easily engaged and removed from the disposable container 12. In one aspect, the cap universal engagement gasket 30 is formed as a unitary part of the cap housing 20.

The cap universal engagement gasket 30 may include a variety of formations which removably and sealingly engage the container mouth 14. In one aspect, the cap universal engagement gasket 30 may comprise a flange support 40 and a plurality of semi-flexible flange discs 42 connected to or extending from the flange support 40 (see FIGS. 3 and 4A). The semi-flexible flange discs 42 deform as the cap universal engagement gasket 30 is pressed into the container mouth 14 to provide a seal between the cap housing 20 and the disposable container 12. That is, the cap universal engagement gasket is sized to press-fittingly engage and seal against the target container's container mouth.

In accordance with another aspect, the plurality of semi-flexible flange discs 42' are tapered in diameter as it extends between a first semi-flexible flange disc 44' and a second semi-flexible flange disc 46' or subsequent semi-flexible flange disc (see FIG. 4B). This tapering allows the cap universal engagement gasket 30' to engage a wide variety of varied size container mouths. In the present aspect, the taper is defined by an increase in diameter between the first semi-flexible flange disc 44' to the second semi-flexible flange disc 46' to allow the cap universal engagement gasket 30' to engage a range of mouth inner diameters. In this aspect, the plurality of semi-flexible flange discs 42' taper inwardly towards the cap centerline axis 24' (see FIG. 4B) as it extends from the flange support so as to facilitate centering and engagement with a mouth of a disposable container.

The universal water pipe adapter 10 further includes a slide assembly 48 having a slide bowl 50 and a slide tube 52 (see FIG. 2). The slide tube 52 defines a slide tube exterior diameter 54. In one aspect, the slide tube exterior diameter 54 is closely matched to the slide port diameter 34 to provide a sealing engagement with the cap housing 20 while still allowing the slide tube 52 to be slid in and out of the cap housing 20. That is, the slide tube is sized to sealingly engage the slide port.

Although the slide assembly 48 may be formed of a variety of materials, in one aspect the slide assembly is formed from one of metal, plastic, silicon, rubber and glass. In another aspect, the slide bowl 50 is formed from a flame and heat resistant material, such as a glass, a metal, and/or a ceramic.

The slide tube 52 defines a slide tube length 56. When the disposable container 12 is at least partially filled with water or other liquids, the slide tube length 56 allows the slide tube 52 to be inserted through the slide port 32 such that it passes below the liquid fill line. In operation, when combustible material is placed within the slide bowl 50 and ignited, the inhale port 38 allows for fluid communication with the slide tube 52, through the liquid, and upwards out the inhale channel 36, when a suction or pressure drop e.g., via the drawing of a breath by a user, is presented.

Figure 6:
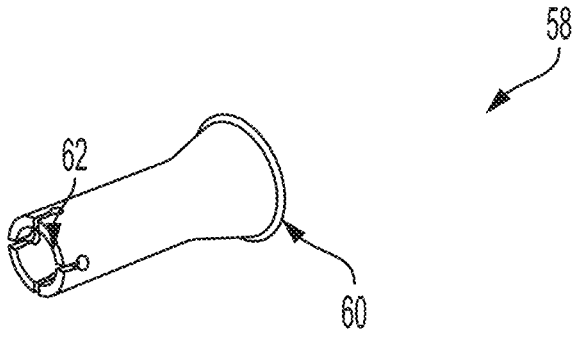
FIG. 6 is a perspective view of a removable mouthpiece for use in the universal water pipe adapter of FIG. 1.
Figure 7:
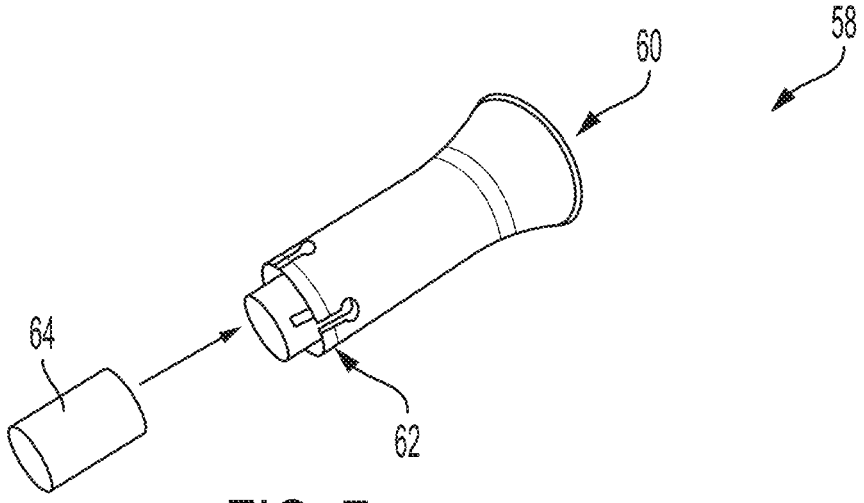
FIG. 7 is a perspective view of the removable mouthpiece of FIG. 6 illustrating a filter chamber.

The universal water pipe adapter 10, in one aspect, may include a removable mouthpiece 58 (FIGS. 6 and 7). The removable mouthpiece 58 includes an inlet 60 and an attachment end 62 opposite the inlet. The attachment end 62 is configured to removably engage the inhale port 38 of the cap housing 20. The attachment end includes a fastener 61 for releasably engaging the inhale port. The fastener can include threading, a snap-lock, luer lock or other fasteners known in the art and suitable for the intended purpose. The removable mouthpiece 58 may further include a filter chamber 64 that may include charcoal or other air purifying features. When combined with the natural filtration of the liquid in the disposable container 12, the filter chamber 64 provides a reduction of inhaled adulterants.

Figure 8:
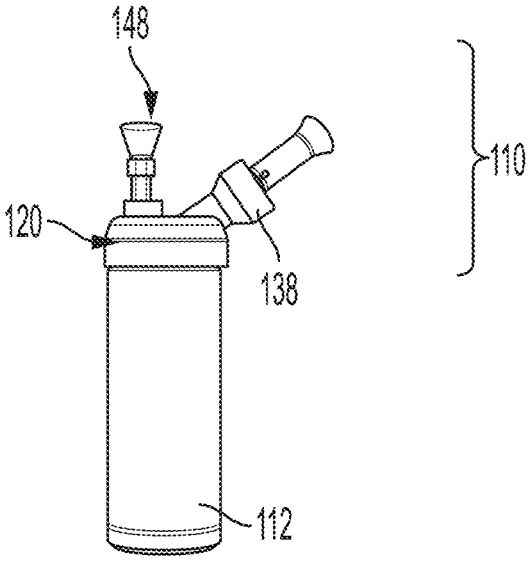
FIG. 8 is a side view of a universal water pipe adapter in accordance with another exemplary embodiment of the subject disclosure.
Figure 9:
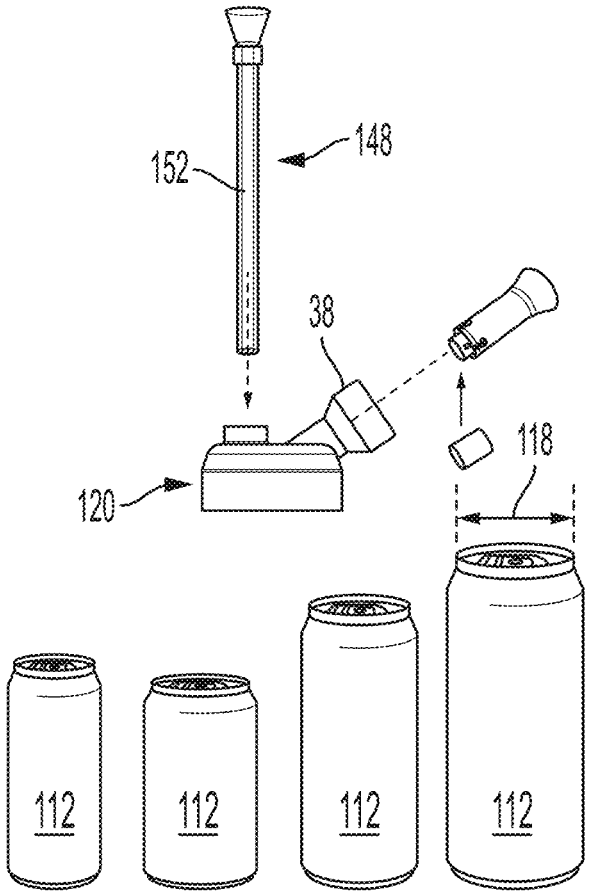
FIG. 9 is an exploded side view of the universal water pipe adapter of FIG. 8.

FIGS. 8-9 illustrate a universal water pipe adapter 110 constructed in accordance with another aspect of the subject disclosure. Universal water pipe adapter 110 is substantially similar to universal water pipe adapter 10, except as further described herein. In the current aspect, the universal water pipe adapter 110 may be configured to "fit over" and seal against the exterior of the disposable container. In the present aspect, disposable container 112 may be comprised of a can or other similar structure. In this aspect, the universal water pipe adapter 110 engages the exterior of the disposable container diameter 118 as opposed to the mouth inner diameter.

Figure 10:
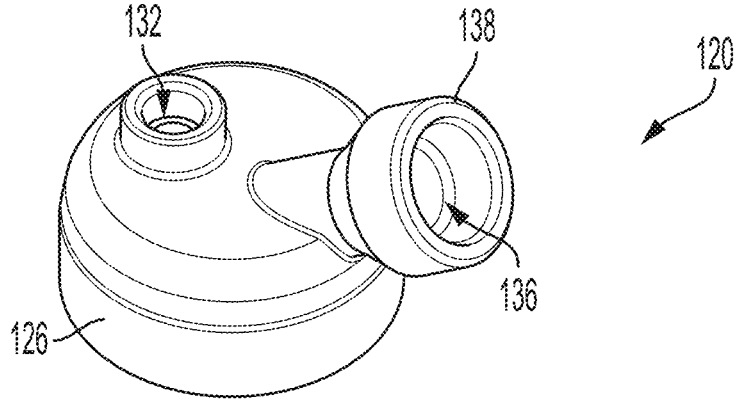
FIG. 10 is a perspective view of a cap housing for use with the universal water pipe adapter of FIG. 8.
Figure 11:
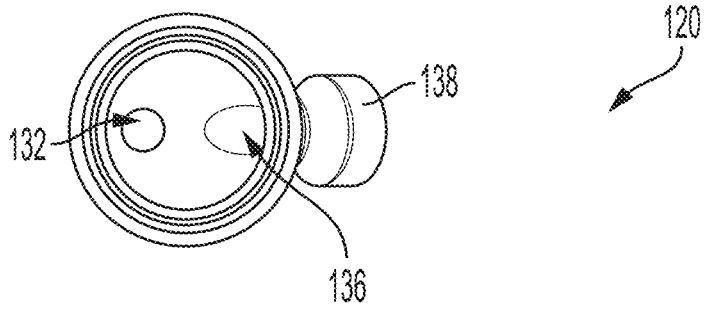
FIG. 11 is a bottom view of the cap housing of FIG. 10.
Figure 12:
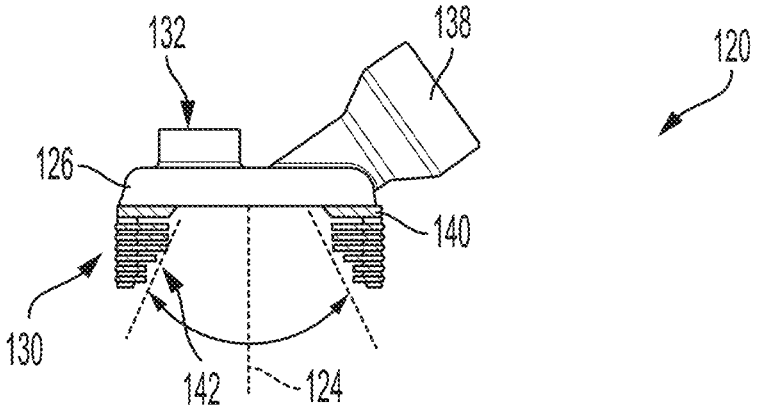
FIG. 12 is a partial cross-sectional side view of the cap housing of FIG. 10.
Figure 13:
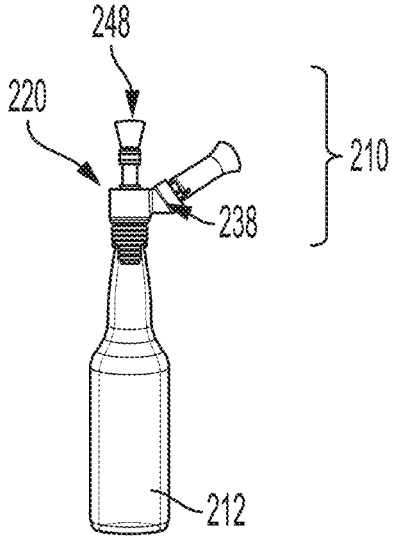
FIG. 13 is a side view of a universal water pipe adapter in accordance with another exemplary embodiment of the subject disclosure.
Figure 14:
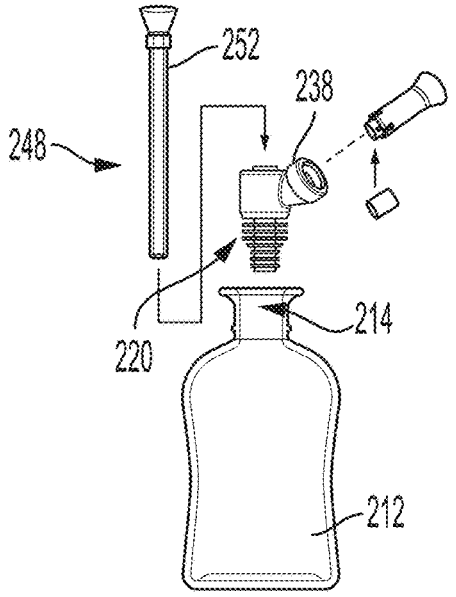
FIG. 14 is an exploded side view of the universal water pipe adapter of FIG. 13.
Figure 15:
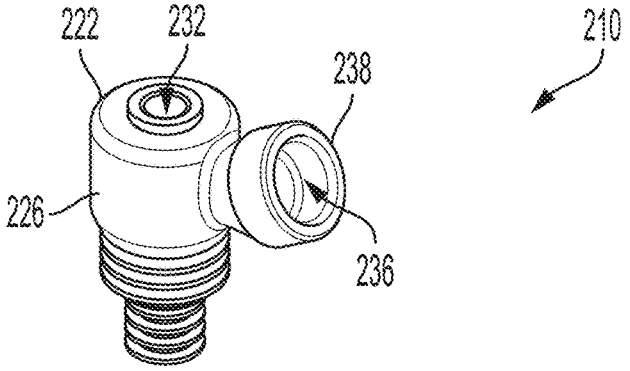
FIG. 15 is a perspective view of a cap housing for use with the universal water pipe adapter of FIG. 13.
Figure 16:
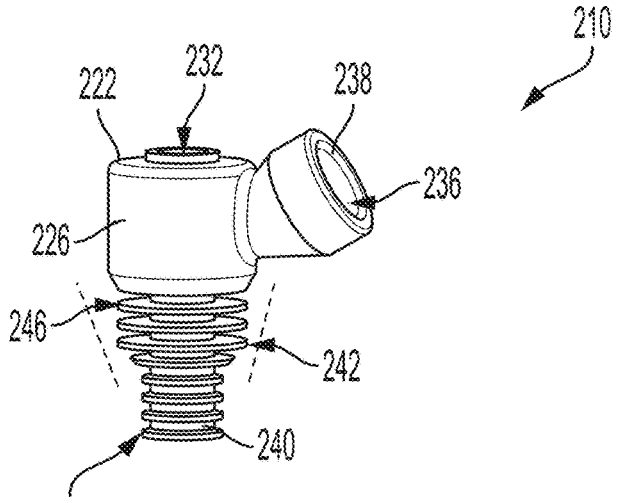
FIG. 16 is a side view of the cap housing of FIG. 15.
Figure 17:
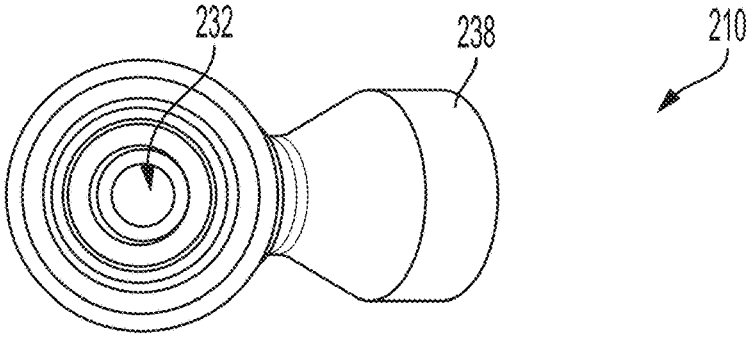
FIG. 17 is a bottom view of the cap housing of FIG. 15.

In this aspect, the cap housing 120 is formed in a configuration shown in FIGS. 10-12. The cap housing 120 includes a side panel 126, slide port 132, an inhale channel 136 and an inhale port 138. In this aspect, the cap universal engagement gasket 130 is configured to surround the mouth outer diameter 118 of the disposable container 112.

In this aspect, the cap universal engagement gasket 130 comprises a plurality of semi-flexible flange discs 142 extending downwardly from the flange support 140 and towards the cap centerline axis 124 (see FIG. 12). Each of the plurality of semi-flexible flange discs 142 are sized to decrease in inner diameter so as to form a tapered mouth, e.g., the diameter of the first semi-flexible flange disc 144 is larger than a diameter of the second semi-flexible flange disc 146. This allows the cap universal engagement gasket 130 to adapt to a wide range of can diameters. In this aspect, it is contemplated that the slide port 132 is configured to be aligned with the standard can pop top 166 such that as the slide tube 152, of the slide assembly 148, passes through the slide port 132 it simultaneously passes through the pop top 166. The cap housing 120 includes an inhale channel 136 and an inhale port 138.

FIGS. 13-17 illustrate a universal water pipe adapter 210 constructed in accordance with another exemplary embodiment of the subject disclosure. Universal water pipe adapter 210 is substantially similar to universal water pipe adapter 110, except as further described herein. In this aspect, the cap housing 220 and cap cover 222 are configured to engage the inner mouth of a bottle. In the present aspect, disposable container 212 may be comprised of a pop bottle, beer bottle or other similar bottle type structure. The cap housing 220 includes an inhale channel 236 and an inhale port 238. The disposable container may have a narrow and centered container mouth 214. The slide port 232 is preferably aligned with a cap centerline axis 224. In this fashion, as the slide assembly 248 is slid through the slide port 232, the slide tube 252 may enter unobstructed into the bottle. The universal water pipe adapter 210 also includes a gasket having a plurality of semi-flexible flange discs 242 extending from the flange support 240. In one aspect, the gasket tapers in diameter. That is, the diameter of a semi-flexible flange disc 246 about a top end of the gasket is larger than a diameter of a semi-flexible flange disc 244 about a bottom end or a subsequently adjacent semi-flexible flange disc distal to the slide port. This allows the universal water pipe adapter 210 to accommodate a wide range of bottle neck diameters.

Figure 18:
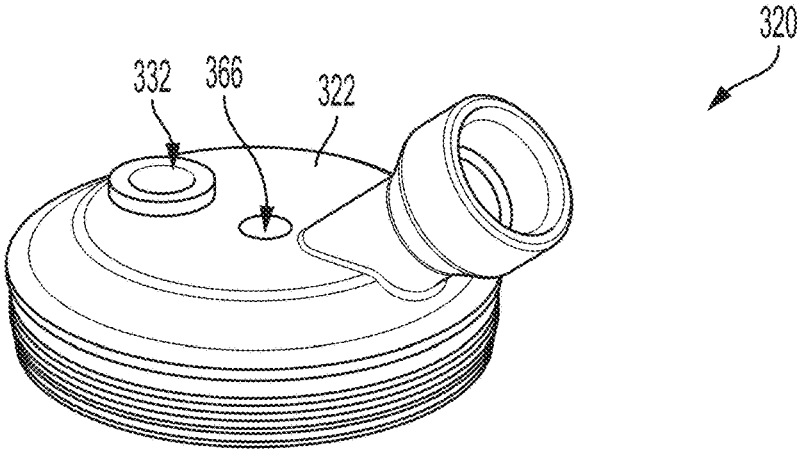
FIG. 18 is a perspective view of a cap housing in accordance with another exemplary embodiment of the subject disclosure.
Figure 19:
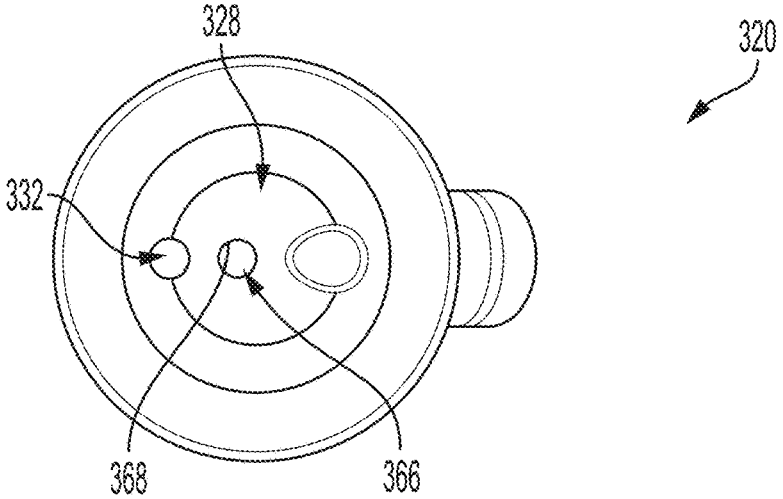
FIG. 19 is a bottom view of the cap housing of FIG. 18.

FIGS. 18-19 illustrate a cap housing 320 constructed in accordance with another exemplary embodiment of the subject disclosure. The cap housing 320 is substantially similar to the cap housing 20 of universal water pipe adapter 10, except as further described herein. In this aspect, the cap housing 320 includes a carb port 366 to allow the user to selectively direct external air into the cap cavity 328. In the present aspect, the cap housing 320 may include a car port 366 positioned centrally about a cap cover 322 and in fluid communication with the cap cavity 328 using a carb port channel 368. The carp port 366 allows a user to selectively cover the carb port and direct all airflow through a slide port 332. This allows increased airflow through the slide port 332 and therefore increased combustion of material burning in a slide bowl (not shown) used in combination with the cap housing. The user may also remove their finger from the carb port 366 to reduce combustion and inhale gases from within the disposable container.

Figure 20:
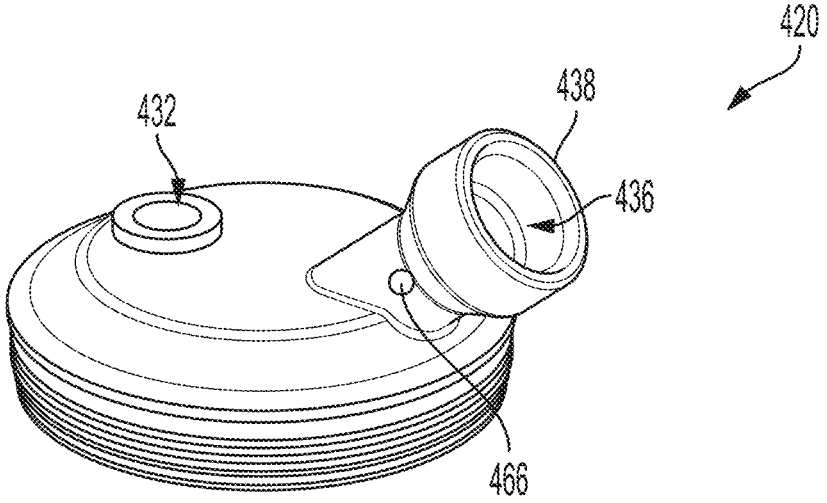
FIG. 20 is a perspective view of a cap housing in accordance with another exemplary embodiment of the subject disclosure.

FIG. 20 illustrates a cap housing 420 constructed in accordance with exemplary embodiments of the subject disclosure. In this aspect, a carp port 466 may be formed adjacent an inhale channel 436 on the inhale port 438. This provides a more convenient location for the carb port 466 as well as drawing atmospheric air into the cap housing's cap cavity bypassing the slide port 432 and thereby at a position closer to a liquid fill level when used with a disposable container. In another aspect (FIG. 21), a carb channel 468' is comprised of a separate channel from the inhale channel 436' but running parallel to the inhale channel 436'. This provides a more convenient location for the carb port 466' as well as drawing atmospheric air into the cap housing's cap cavity bypassing the slide port 432' and thereby at a position closer to a liquid fill level when used with a disposable container. A sealing gasket 433' may be used in conjunction with the slide port 432'.

Figure 22:
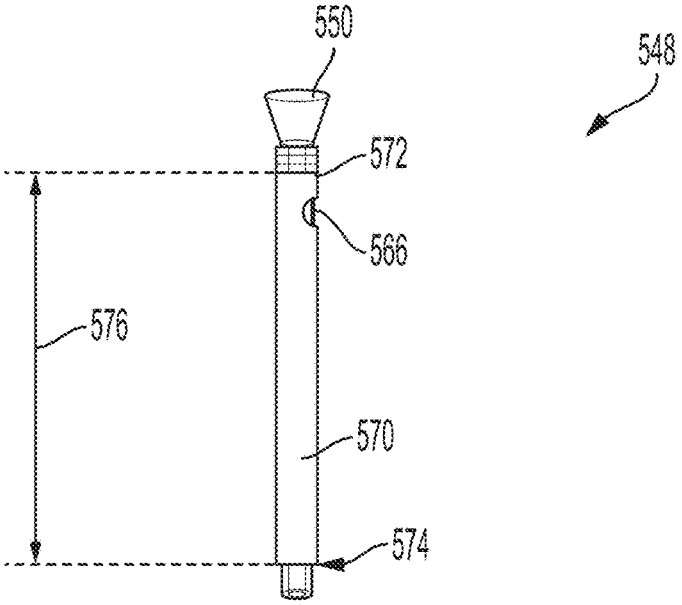
FIG. 22 is a side view of a slide assembly in accordance with another exemplary embodiment of the subject disclosure.
Figure 23:
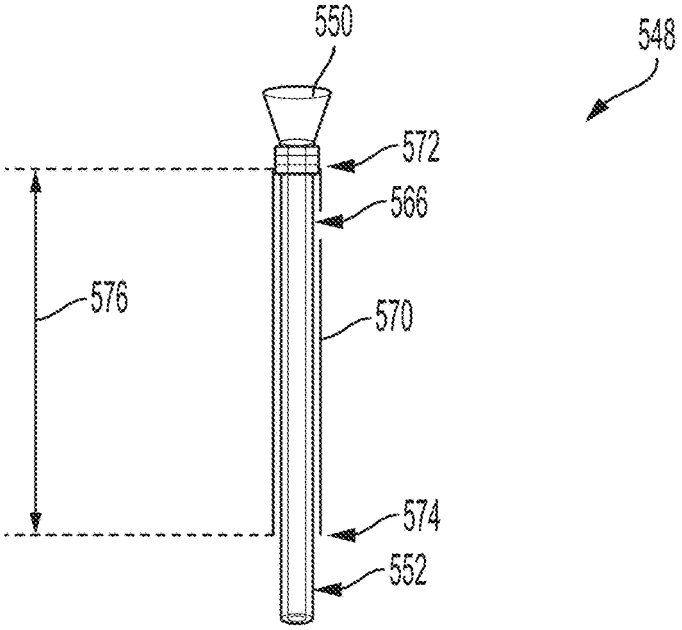
FIG. 23 is a side view of the slide assembly of FIG. 22 with a sleeve shown in cross-section.
Figure 24:
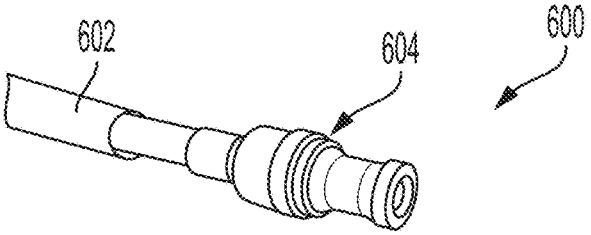
FIG. 24 is a perspective view of an adapter according to another aspect of the disclosure.
Figure 25:
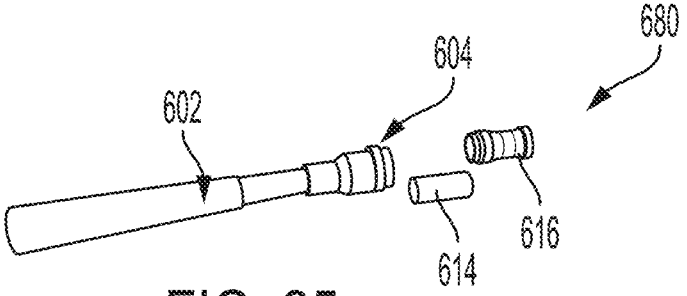
FIG. 25 is an exploded view of the adapter shown in FIG. 24.
Figure 26A:
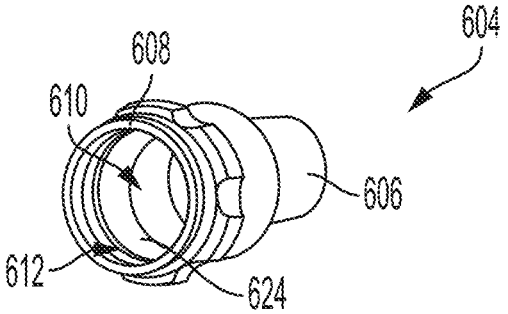
FIG. 26A is a perspective detailed view of a main pipe adapter for use with the adapter shown in FIG. 24.
Figure 26B:
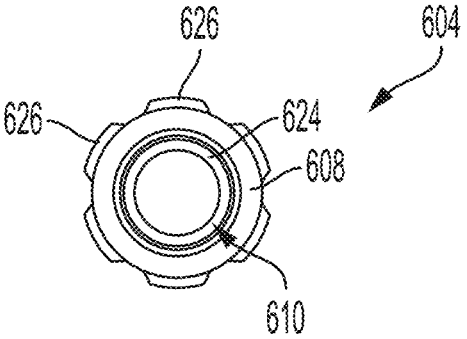
FIG. 26B is a front view of the main pipe adapter shown in FIG. 26A.
Figure 26C:
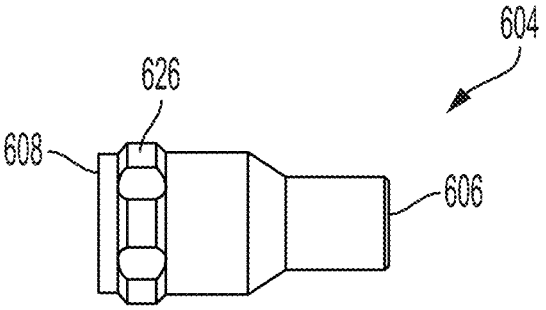
FIG. 26C is a side view of the main pipe adapter shown in FIG. 26A.
Figure 27A:
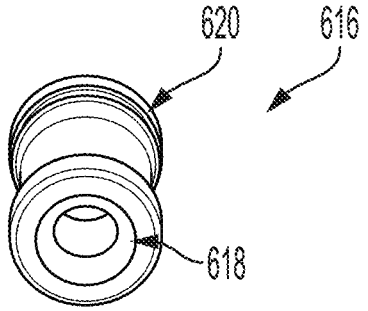
FIG. 27A is a front view of a mouthpiece adapter for use with the adapter shown in FIG. 24.
Figure 27B:
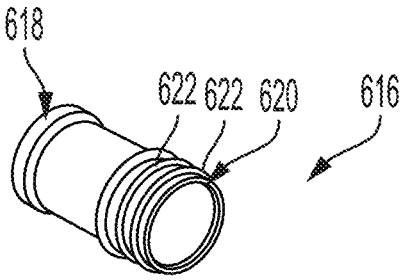
FIG. 27B is a perspective detailed view of the mouthpiece adapter shown in FIG. 27A.
Figure 27C:
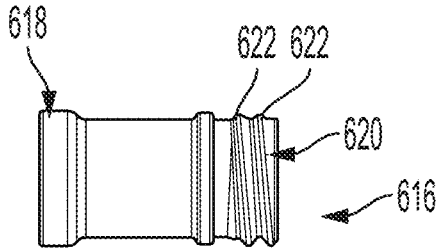
FIG. 27C is a side view of the mouthpiece adapter shown in FIG. 27A.

FIGS. 22-23, illustrate a slide assembly 548 in accordance with another exemplary embodiment of the subject disclosure. The slide assembly 548 is substantially similar to slide assembly 48, except as further described herein. In this aspect, the universal water pipe adapter includes a carb tube 570 surrounding a slide tube 552 and having a sealed carb tube end 572 adjacent to the slide bowl 550 and an open carb tube end 574 distal to the slide bowl 550. The carb port 566 is formed in the carb tube 570 below the sealed carb tube end 572. The carb tube 570 has a carb tube length 576 that is smaller or less than the slide tube length. The shorter carb tube length 576 allows the open carb tube end 574 to remain above any liquid while the slide tube 552 is allowed to pass below the liquid. This allows an operator to selectively direct airflow either through the liquid or above the liquid or in some combination. Although the carb tube 570 may be made of a variety of materials, in one aspect it is contemplated that the carb tube 570 be made of metal. This provides additional protection for the slide tube 552 in case of accidental droppage.

FIGS. 24-27C illustrate a universal pipe adapter 600 in accordance with another exemplary embodiment of the disclosure. The universal pipe adapter 600 is substantially similar to removable mouthpiece 58, except as further described herein. The universal pipe adapter 600 is configured to be used with a pre-rolled burnable element 602, such as a rolled tobacco or other herb rolled element. The universal pipe adapter 600 includes a main pipe adapter 604 having a first adapter end 606 configured to frictionally retain the pre-rolled burnable element 602 by way of a chamfered inner surface. The main pipe adapter 604 additionally includes a second adapter end 608 having a filter retention chamber 610 and including one or more main retention ridges 612. A filter element 614 is positioned within the filter retention chamber 610.

The universal pipe adapter 600 further includes a mouthpiece adapter 616 having a mouth port 618 and an engagement port 620. The engagement port 620 includes one or more mouthpiece retention ridges 622. The one or more mouthpiece retention ridges 622 removably engage the main retention ridges 612 to secure the filter element 614 in the filter retention chamber 610. In this fashion, when a user draws on the mouth port 618, smoke from the pre-rolled burnable element 602 is forced through the filter element 614 prior to being inhaled by the user. In one aspect, the filter retention chamber 610 includes a chamfered base 624 to allow the filter element 614 to be compressed and form a tight seal. The main pipe adapter 604 includes one or more grip protrusions 626 to assist in the user's engagement and disengagement of the mouthpiece adapter 614 from the main pipe adapter 604.

It will be appreciated by those skilled in the art that changes could be made to the exemplary embodiments described above without departing from the broad inventive concept thereof. It is to be understood, therefore, that this disclosure is not limited to the particular exemplary embodiments disclosed, but it is intended to cover modifications within the spirit and scope of the subject disclosure as defined by the appended claims.

We claim:

1. A universal water pipe adapter for use with a disposable container, comprising:

a cap housing including a cap cover, a cap centerline axis, a cap cover side panel, a cap cavity, and a cap universal engagement gasket, the cap universal engagement gasket for removably engaging and sealing to a container mouth of a disposable container;

a slide port formed in the cap cover, the slide port connecting the cap cover to the cap cavity;

an inhale channel positioned on the cap cover, the inhale channel connecting an inhale port to the cap cavity;

a slide assembly including a slide bowl and a slide tube, wherein the slide assembly is configured to pass through the slide port and seal against the slide port;

a carb port positioned externally from the cap cavity;

a carb port channel placing the carb port in communication with the cap cavity; and a carb tube surrounding the slide tube and forming the carb port channel between the carb tube and the slide tube, the carb tube sealed to the slide tube proximate the slide bowl and open distal from the slide bowl, the carb tube having a carb tube length shorter than the slide tube length, wherein the carb port is positioned on the carb tube proximate the slide bowl.

2. The universal water pipe adapter of claim 1, wherein the cap universal engagement gasket comprises a flange support and a plurality of semi-flexible flange discs connected to the flange support and tapered from a first engagement gasket end to a second engagement gasket end.

3. The universal water pipe adapter of claim 1, further comprising:

a removable mouthpiece including a breathing end and an attachment end, the attachment end configured to releasably engage the inhale port; and a filter chamber removably positioned within the attachment end and secured between the attachment end and the inhale port.

4. The universal water pipe adapter of claim 2, wherein the plurality of semi-flexible discs extends from the flange support away from the cap centerline axis, or extends from the flange support towards the cap centerline axis.

5. The universal water pipe adapter of claim 1, wherein the cap housing comprises at least one of anti-bacterial properties, anti-bacterial additives, anti-bacterial films, and anti-bacterial coatings.

6. The universal water pipe adapter of claim 1, wherein the slide assembly is comprised of a metal, a plastic, a silicon, a rubber, or glass.

7. The universal water pipe adapter of claim 1, wherein the carb tube is comprised of metal and the slide tube is comprised of glass.

8. A universal water pipe adapter for use with a disposable container comprising:

a cap housing defining a cap centerline axis, a cap cavity, a flange support and a plurality of semi-flexible flange discs connected to the flange support and tapered from a first engagement gasket end to a second engagement gasket end, the flange support formed as a unitary portion of the cap housing, the plurality of semi-flexible flange discs configured to removably engage and seal to the container mouth;

a slide port formed in the cap housing;

an inhale channel positioned on the cap cover, the inhale channel connecting an inhale port to the cap cavity; and a slide assembly including a slide bowl and a slide tube, the slide assembly configured to pass through and seal against the slide port;

a carb port positioned externally from the cap cavity;

a carb port channel placing the carb port in communication with the cap cavity; and a carb tube surrounding the slide tube and forming the carb port channel between the carb tube and the slide tube, the carb tube sealed to the slide tube proximate the slide bowl and open distal from the slide bowl, the carb tube having a carb tube length shorter than the slide tube length, wherein the carb port is positioned on the carb tube proximate the slide bowl.

9. The universal water pipe of claim 8, wherein the plurality of semi-flexible discs extends from the flange support away from the cap centerline axis, or extends from the flange support towards the cap centerline axis.

10. The universal water pipe of claim 8, further comprising:

a mouthpiece including a breathing end and an attachment end, the attachment end configured to engage the inhale port; and a filter chamber positioned within the attachment end and secured between the attachment end and the inhale port.

* * * * *